US006640897B1

(12) United States Patent
Misselbrook et al.

(10) Patent No.: US 6,640,897 B1
(45) Date of Patent: Nov. 4, 2003

(54) METHOD AND APPARATUS FOR THROUGH TUBING GRAVEL PACKING, CLEANING AND LIFTING

(75) Inventors: John G. Misselbrook, Houston, TX (US); Richard A. Altman, Kingwood, TX (US)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 10/070,876

(22) PCT Filed: Sep. 10, 1999

(86) PCT No.: PCT/US99/20783

§ 371 (c)(1),
(2), (4) Date: Apr. 15, 2002

(87) PCT Pub. No.: WO01/20124

PCT Pub. Date: Mar. 22, 2001

(51) Int. Cl.[7] ..... E21B 43/04
(52) U.S. Cl. ..... 166/278; 166/51; 166/312
(58) Field of Search ..... 166/278, 312, 166/51, 77.2

(56) References Cited

U.S. PATENT DOCUMENTS

| | | | | |
|---|---|---|---|---|
| 2,041,911 | A | 5/1936 | Erickson | 154/44 |
| 2,823,374 | A | 4/1958 | November | 138/50 |
| 3,361,202 | A | 1/1968 | Whipple | 166/10 |
| 3,397,745 | A | 8/1968 | Owens et al. | 166/57 |
| 3,574,357 | A | 4/1971 | Alexandru et al. | 285/47 |

(List continued on next page.)

FOREIGN PATENT DOCUMENTS

| | | | |
|---|---|---|---|
| CA | 852553 | 9/1970 | 166/2 |
| CA | 1325969 | 10/1987 | 166/53 |
| WO | WO97/01017 | 1/1997 | E21B/19/22 |
| WO | WO97/35093 | 9/1997 | |

OTHER PUBLICATIONS

Falk et al., "Sand Clean–out Technology for Horizontal Wells" The Petroleum Society of CIM, Paper 95–97; Appendix: Sand–Vac Case Histories (first 5 jobs); 7 pages, XP–002103546.

Cure et al., "Jet–assisted drilling nears commercial use" Oil & Gas Journal, Drilling Technology Report, Week of Mar. 11, 1991, 6 pages.

Hoyer et al., "Test, Treat, Test System Using a Concentric Coiled Tubing/DST Package" The Petroleum Society Paper, 8 pages.

Liderth,"Elan Showing Positive Single–Well SAGD Results" Daily Oil Bulletin, p. 3, Tuesday, May 2, 1991 by; Fig. 6 drawing, 2D15–16–36–28 W3M Steam Pilot single Well SAGD, 1 page; Fig_drawing, High Temperature Bottomhole Temperature Measurement System (Morep System, 1 page; Unique Insulated Coiled Tubing System; 1 page.

Nowsco , "Underbalanced Drilling", 7 pages.

Nowsco , "Drill Stem Testing With Concentric Coiled Tubing Current Status", 7 pages.

S.J. Fried, et al, "*The Selective Evaluation and Stimulation of Horizontal Wells Using Concentric Coiled jTubing*" Society of Petroleum Engineers of AIME, presented at the 1996 SPE International Conference on Horizontal Well Technology held in Calgary, Canada, Nov. 18–20, 1996; 8 pages.

*Primary Examiner*—William Neuder
(74) *Attorney, Agent, or Firm*—Howrey Simon Arnold & White, LLP

(57) ABSTRACT

Method and Apparatus for gravel packing, cleaning and lifting wells, including through tubing methods, circulating well fluids through a coiled tubing string having a leak protection barrier operable for at least a portion of the string passing above a wellhead and employing a circulating and release sub.

28 Claims, 11 Drawing Sheets

U.S. PATENT DOCUMENTS

| | | | | | |
|---|---|---|---|---|---|
| 3,643,702 | A | | 2/1972 | Kauder | 138/121 |
| 4,167,111 | A | | 9/1979 | Spuck, III | 73/155 |
| 4,252,015 | A | | 2/1981 | Harbon et al. | 73/151 |
| 4,629,218 | A | | 12/1986 | Dubois | 285/176 |
| 4,635,725 | A | * | 1/1987 | Burroughs | 166/278 |
| 4,744,420 | A | | 5/1988 | Patterson et al. | 166/312 |
| 4,842,068 | A | | 6/1989 | Vercaemer et al. | 166/269 |
| 4,856,590 | A | | 8/1989 | Callier | 166/278 |
| 4,860,831 | A | * | 8/1989 | Caillier | 166/384 |
| 4,940,098 | A | | 7/1990 | Moss | 175/320 |
| 5,033,545 | A | | 7/1991 | Sudol | 166/312 |
| 5,086,842 | A | | 2/1992 | Cholet | 166/312 |
| 5,287,741 | A | | 2/1994 | Schultz et al. | 73/155 |
| 5,348,097 | A | | 9/1994 | Giannesini et al. | 166/385 |
| 5,351,533 | A | | 10/1994 | Macadam et al. | 73/155 |
| 5,353,875 | A | | 10/1994 | Schultz et al. | 166/297 |
| 5,419,188 | A | | 5/1995 | Rademaker et al. | 73/151 |
| 5,435,395 | A | | 7/1995 | Connell | 166/384 |
| 5,503,014 | A | | 4/1996 | Griffith | 73/155 |
| 5,638,904 | A | | 6/1997 | Misselbrook et al. | 166/384 |
| 6,015,015 | A | | 1/2000 | Luft et al. | 166/384 |

* cited by examiner

FIG. 17
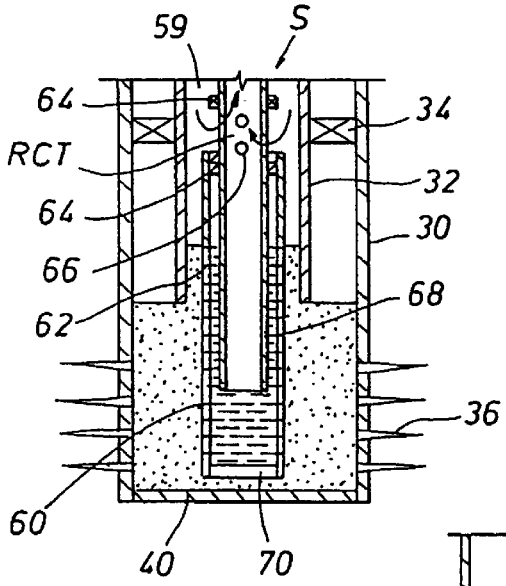
FIG. 18
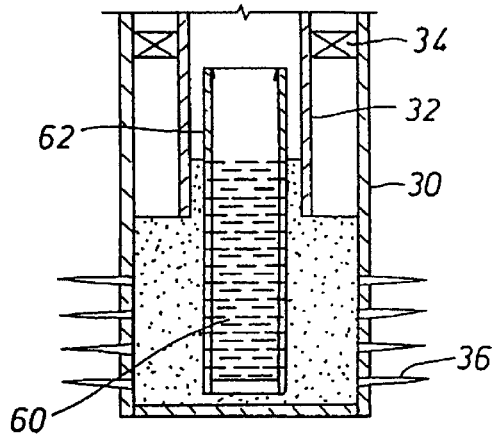
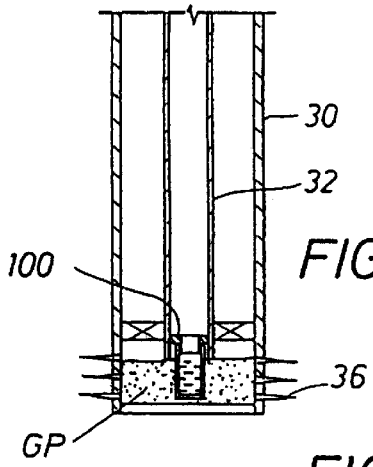
FIG. 21
FIG. 19
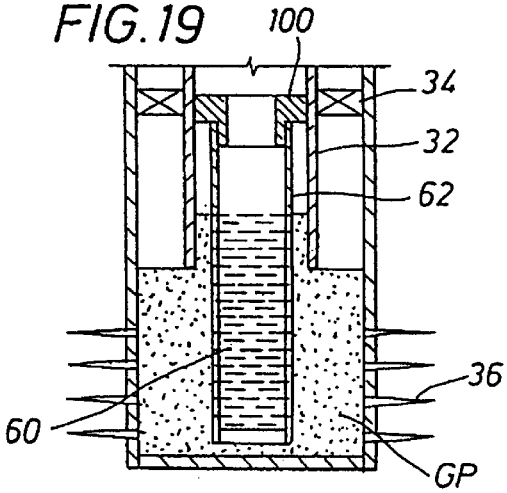
FIG. 20
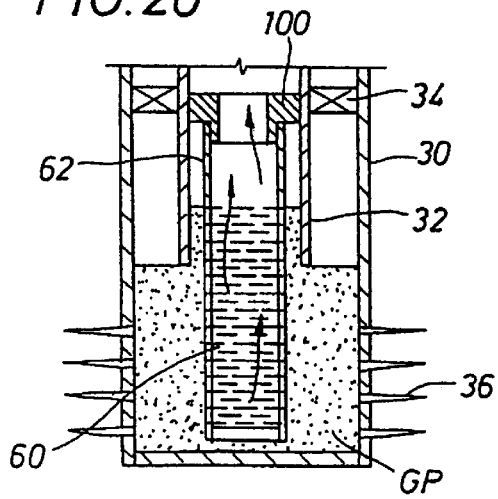

METHOD AND APPARATUS FOR THROUGH TUBING GRAVEL PACKING, CLEANING AND LIFTING

FIELD OF INVENTION

This invention relates to methods and apparatus for coiled tubing operations in a wellbore, and in particular to methods and apparatus for reverse circulating well fluid through a coiled tubing string, such as for gravel packing, cleaning and lifting, and which is particularly applicable to through tubing operations.

BACKGROUND OF INVENTION

This invention is tangentially related to U.S. Pat. No. 5,638,904 "Safeguarded Method and Apparatus for Fluid Communication Using Coiled Tubing, With Application to Drill Stem Testing," Inventors Misselbrook et al.; PCT Application Number US 97/03563 filed Mar. 5, 1997 entitled "Method and Apparatus using Coil-in-Coil Tubing for Well Formation, Treatment, Test and Measurement Operations," Inventors Misselbrook et al; and U.S. patent application Ser. No. 08/564,357 filed Jan. 27, 1997, entitled "Insulated and/or Concentric Coiled Tubing."

The invention preferably incorporates a coiled tubing string having a protective safety barrier, at least along upper portions. The string may advantageously be used for well enhancing operations carried out by flowing well fluids through the coiled tubing. In a preferred embodiment, utilizing an at least partial coil-in-coil tubing string (sometimes referred to as PCCT for convenience, provides a protective safety barrier at the surface to ameliorate any concerns of a particular job about safely producing well fluids through coiled tubing.

The option to produce well fluids through a workstring can yield enhanced methods for gravel packing wells, to name one example, including in particular working through existing completions. In gravel packing, higher circulation and sand concentration rates can be attained with a "reverse circulating" system when liquid returns flow up the coiled tubing. This invention can lead to improved placement of gravel along the length of a screen.

Given a capacity for safely flowing well fluids through a coiled tubing string, not only are new and improved means for through tubing gravel packing possible, as mentioned above, but also new and improved means for cleaning wells and for lifting wells with coiled tubing are available. Possible benefits of the instant invention include more efficient depth control through reasonable certainty in cleaning operations that all sand or fill can be removed prior to a gravel pack. Utilizing readily available natural gas for a gas lift with coiled tubing has cost benefits. The instant system, in addition, may reduce failure risks inherent in pumping gravel pack slurries through a reduced I.D. of a miniaturized tool, a hazard of the present art.

A through tubing gravel pack, preferably using protected coiled tubing strings, additionally implicates the utility of a special coiled tubing apparatus designed for simple reverse circulation. A simple ported stinger, or reverse circulation tool, also referred to as a circulating and release sub, offers a regulatable circulation port and a release mechanism that can eliminate requirements for more costly mechanical packers and crossover tools.

To review particulars of the inventive system in more detail, preferred embodiments may utilize a gravel pack screen, blank pipe, wash pipe, and a protected coiled tubing string, such as PCCT, to effect gravel packing wherein an internal portion of a gravel pack screen is isolated with seals that attach between a reverse circulation tool and the upper end of a blank pipe attached to the gravel pack assembly. The screen assembly may be connected to the coiled tubing by a simple ported stinger, referred to herein as a reverse circulation tool or a circulating and release sub. The tool is preferably latched and sealed against a profiled extension tube forming part of a standard blank pipe attached above the screen. A gravel pack slurry is pumped down a well—PCCT annulus, around the outside of the profiled extension tube and down the outside of the screen. A production/completion coiled tubing annulus typically offers a cost effective flow path for a slurry, preferable to the small bore of a coiled tubing string itself. Carrier fluid flows through the screen and returns up a washpipe typically carried below the tool, through the re-circulation tool and up the coiled tubing. As the sand fills the annulus around the gravel pack screen and the liquid returns, including well fluids, flow up the coiled tubing string, the returns are preferably protected at the surface by a safety barrier associated with the coiled tubing. Flowing down an annular space and up a workstring is sometimes referred to as reverse circulation.

After sand screen out occurs, the string, sub and washpipe can be released from the gravel pack screen and blank pipe assembly and returned to the surface. With the gravel pack in place, tension applied to the coiled tubing can be used to disengage a sub from a profiled extension tube of a blank pipe. Disengagement can be effected by utilizing a simple release mechanism incorporated in a sub. Disengagement and a slight movement of the string can subsequently place circulation ports of a sub in communication with a well-coiled tubing annulus and permit reverse circulation for a period of time to clean out excess slurry from the annulus.

When reverse flow conditions show clean, indicating slurry removal, the string, circulation and release sub and flow tube or washpipe can be removed from the well. A safety check valve which may be selectively engaged may advantageously be provided toward the distal end of the coiled tubing string and sub assembly to provide for additional safety during pulling out of hole.

When withdrawn from the well the string preferably leaves a profiled extension tube portion of the blank pipe exposed and free of any debris. The gravel pack assembly can then be isolated from completion or production tubing by use of a slickline or coiled tubing set packoff and holddown assembly. Hydraulic isolation of a gravel pack annulus by setting an anchored packer to seal against the profiled extension tube and completion tubing is known in the art. In a majority of instances an anchored sealing mechanism would be run on wireline (or slickline) as being generally quicker and more cost effective than making a second run in a well with coiled tubing.

A protected coiled tubing string, such as PCCT, that permits safe reverse circulation, or safely producing well fluids at the surface through the string, may be advantageously utilized to clean out a well. PCCT may also be advantageously utilized to lift well fluids using readily available natural gas at the surface.

Clean out operations typically precede a gravel pack. In a clean out mode of preferred embodiments of the instant invention, a protected coiled tubing string, such as PCCT, is injected through production tubing to a level of sand plugging the bottom of the well. Clean out fluid is pumped down the annulus of the production tubing coiled tubing string and up the coiled tubing. Flowing the sand up the smaller coiled tubing bore, rather than up the wider annulus, produces greater upward velocities from the same flow rate applied at the surface. The increase in velocity helps prevent the sand from settling back by force of gravity prior to reaching the surface. In deviated wells such increase of velocity to transport the sand is particularly helpful since sand tends to settle by gravity all along the low side of a deviated portion. The ability to achieve high fluid velocities inside coiled tubing permits the use of water as a cleanout fluid and avoids the need for chemical gelling agents which are often required to suspend particles when circulating velocities are low.

Preferred embodiments of the instant invention also exploit cost advantages of lifting a well using a readily available natural gas. Coiled tubing of the preferred embodiment provides a protected path at the surface for pumping down.

SUMMARY OF THE INVENTION

The invention includes methods for performing gravel packing, especially through tubing gravel packing, using coiled tubing. The method includes running, preferably down production tubing, a coiled tubing string. Preferably the string offers a leak protection barrier for at least an upper portion of the string above a wellhead. Although a leak protection barrier may not be in place during the whole time that a PCCT string or the like is being injected, at a significant position and time the string has in place a leak protection barrier for the portion of the string above the wellhead.

Injecting coiled tubing down a well, or down production tubing or completion tubing, creates a well or tubing-coiled tubing annulus. One embodiment of the instant invention includes injecting a gravel pack slurry down this annulus. Well fluids and returns are produced up the coiled tubing string through the wellhead and to the reel. A gravel pack screen assembly may be inserted down the well attached, directly or indirectly, to the coiled tubing string. In preferred embodiments a circulating and release sub would be attached, directly or indirectly, between a screen assembly and a coiled tubing string.

Typically a screen assembly is comprised of a screen attached to the bottom of blank pipe. The screen is located in the wall opposite well perforations and the blank pipe is sufficiently long to extend up from the screen and perforation area into a completion or production tubing. At completion the blank pipe is packed off against the production tubing and forms an extension of that tubing.

The method preferably includes releasing the gravel pack screen from the connection to the coiled tubing downhole before pumping the gravel pack slurry. After pumping the gravel pack slurry the coiled tubing string is raised uncovering a circulation port (or ports) in the circulation and release sub. This allows clean fluid to be circulated down the production tubing—coiled tubing annulus through the port (or ports)and up the coiled tubing which will clean excess sand from around the top of the blank pipe disconnection point. The circulation direction during the cleaning phase could be reverse or conventional. The circulation direction could be reverse or conventional during this phase. The phrase "reverse circulating" generally refers to circulating down a well-coiled tubing annulus and up the tubing.

In one embodiment a method for gravel packing includes cleaning particulate materials such as sand from the bottom of the wellbore prior to injecting a gravel pack slurry. The cleaning is preferably performed by reverse circulating down a well-coiled tubing annulus and up a coiled tubing string, again a string which preferably offers a leak protection barrier between a wellhead and a surface valve. A coiled tubing surface valve is typically located on a coiled tubing reel.

The invention also includes a method for well enhancing that involves cleaning. The method includes injecting down a well (or production tubing) a coiled tubing string having a leak protection barrier operable for at least a portion of the string above the wellhead. The leak protection barrier should be in place above the wellhead during the reverse circulation phase, or during production of well fluid up the coil tubing. Running the string down a production tubing creates a production tubing-coiled tubing string annulus. The method includes circulating fluid down the annulus and reverse circulating fluid and particulate matter up the coiled tubing string bore. The fluid circulated down is typically water, possibly with some additives. The fluid reverse circulated up would include the cleaning fluid such as water as well as any well fluids that might rise during the cleaning process.

The invention also includes a method for lifting fluids from a well. This method includes circulating natural gas or the like down either a well or completion/production tubing-coiled tubing annulus or down a coiled tubing string. Natural gas from the same or other wells may be readily available at the well site and may be cost effectively used for a gas lift. The lifting method includes producing well fluid up either the annulus or string while providing a protective barrier for the coiled tubing string between at least a wellhead and a coiled tubing surface valve. Typically a coiled tubing surface valve is located on a tubing reel. Preferably, the protective barrier for the coiled tubing string includes an inner tubing located in at least an upper portion of the string and further preferably wherein an inner tubing-outer tubing annulus is sealed.

It is recognized that a coiled tubing string could be delivered to a job in multiple pieces. A composite of a single coil tubing string and a coil-in-coil string could be delivered on one spool to a job. Producing a coiled tubing string with a leak protection barrier above a wellhead might involve connecting a single coiled tubing string to a coil-in-coil string using a connector that is manually affixed at the surface, either prior to trucking to a job or subsequently.

The invention also includes apparatus to facilitate reverse circulating and release, as for a gravel pack operation. This apparatus includes coiled tubing, a screen assembly and a circulating and release sub. The sub is attached between the coiled tubing and a screen assembly. The circulating and release sub has at least one port structured to permit fluid access between passages outside and inside the tubing. The sub preferably has at least one seal structured to seal against a portion of the screen assembly. Preferably such seal would seal against a portion of a blank pipe attached to the top of a screen assembly, and most preferably a profiled high strength material portion. The tool also has a release mechanism structured to detach the tool from a screen assembly. A wash pipe may be attached below the circulating and release sub. The sub likely includes a check valve structured to permit and assist reverse circulation. The check valve might also advantageously form part of a release mechanism for the sub.

BRIEF DESCRIPTION OF THE DRAWINGS

A better understanding of the present invention can be obtained when the following detailed description of preferred embodiments are considered in conjunction with the following drawings, in which:

FIGS. 14, 15, 16, 17, 18 and 19 illustrate completing a gravel pack.

FIG. 20 indicates the well placed on production.

FIG. 21 illustrates the gravel pack well.

DETAILED DESCRIPTION OF PREFERRED EMBODIMENTS

Figure 1:
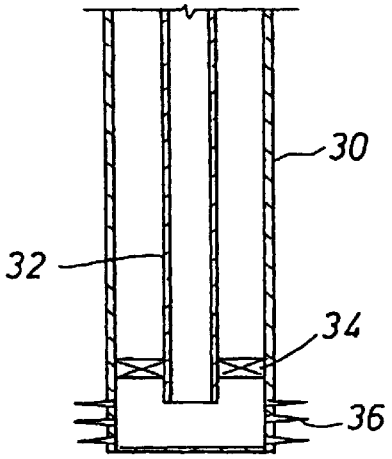
FIG. 1 illustrates a well completion.
Figure 2:
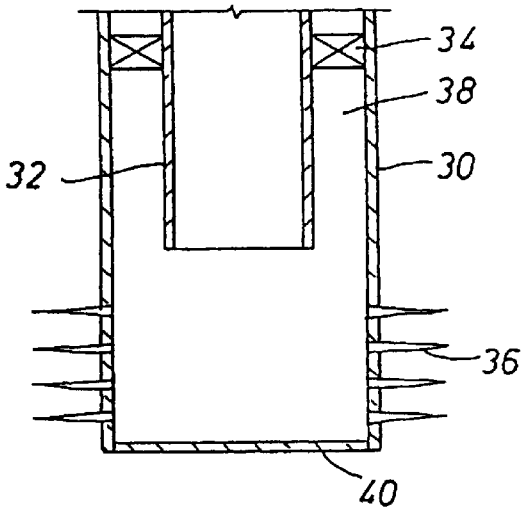
FIG. 2 illustrates a bottom of a well.

FIG. 1 illustrates a typical well completion including casing 30, completion tubing or production tubing 32, packer 34 and perforations 36 in the casing. Well fluids enter casing 30 through perforations 36 and are produced up production tubing 32. Production tubing is used generally synonymously with completion tubing herein. FIG. 2 illustrates the bottom of a completed well including plugback 40. Lower casing annulus 38 is identified.

Figure 3:
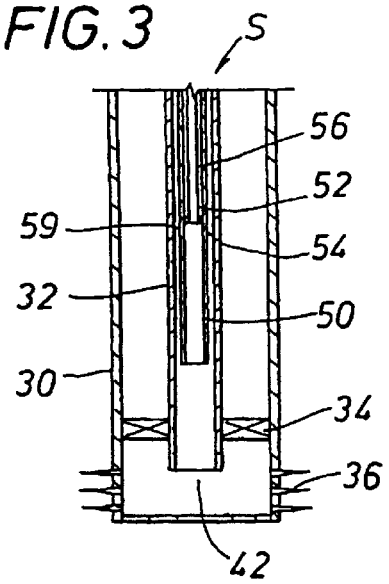
FIG. 3 illustrates portions of partial coil-in-coil tubing string.

FIG. 3 illustrates portions of a partial coil-in-coil tubing string (PCCT), a preferred embodiment for coiled tubing offering a protective barrier between a wellhead and, a surface valve. The string S includes outer coiled tubing 50, inner tubing 52, annulus 56 defined between inner tubing 52 and outer tubing 50 as well as seal 54 sealing annulus 56 between inner tubing 52 and outer tubing 50. Area 42 indicates a wellbore below production tubing 32 and within casing 30.

Figure 4:
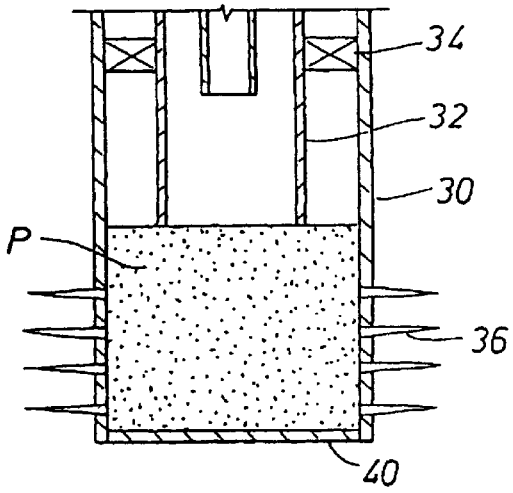
FIG. 4 illustrates particulate matter at the bottom of a well.

FIG. 4 illustrates a sand problem comprising particulate matter P filling the bottom of the well on top of plugback 40 and obscuring or covering production perforations 36. This sand or particulate matter P is illustrated extending up area 42 and covering the bottom of production tubing 32.

Figure 5:
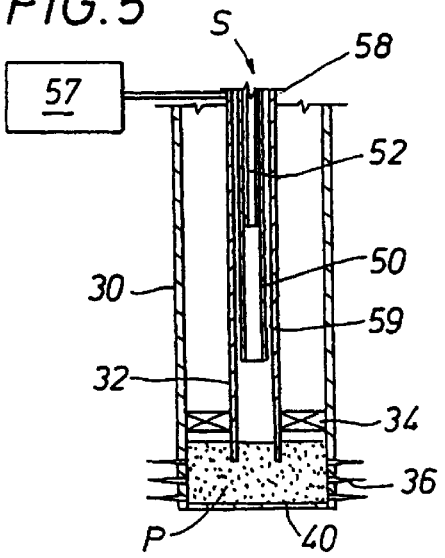
FIG. 5 illustrates injecting fluid for cleanout.

In FIG. 5, equipment 57 illustrates equipment known in the art that is capable of injecting fluid, such as a clean out fluid or a slurry, downhole, including down production tubing 32 into annulus 59 to flow between string S and production tubing 32. The fluid is indicated as reverse circulating by proceeding down annulus 59 and up the inside of outer tubing 50 and subsequently up inner tubing 52 of string S. A production tree or wellhead 58 (not shown) exists at the surface to control well fluids in production tubing 32, as is known in the art.

Figure 6:
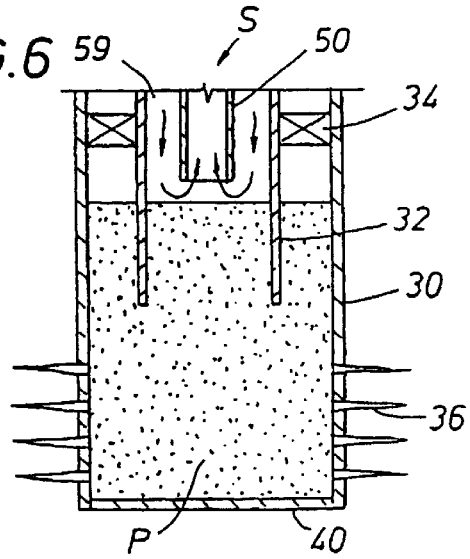
FIG. 6 illustrates using string S to begin a cleaning operation.
Figure 7:
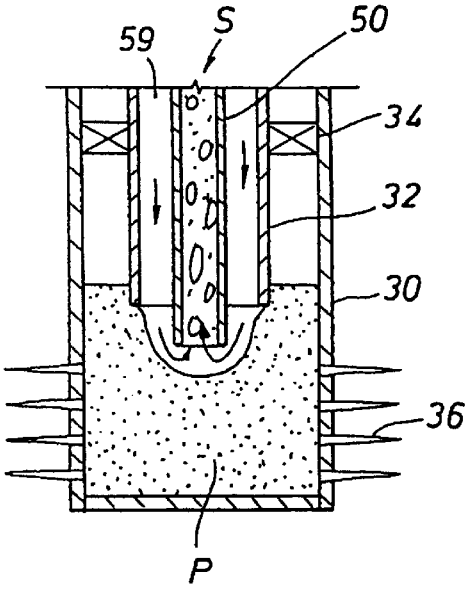
FIG. 7 illustrates the process of the cleaning process.

FIG. 6 indicates using string S beginning a cleaning operation of particulate matter P from the bottom of a well, which matter is obscuring perforations 36. String S has been lowered and fluid, usually water and including possibly gas, is indicated as circulating down annulus 59 between production tubing 32 and string S. FIG. 6 indicates the fluid reverse circulating up the inside of outer tubing 50 of coiled tubing string S. The gas and/or the fluid circulated down could include nitrogen, creating a nitrified fluid. As indicated in FIG. 6, fluid circulating up string S includes the fluid pumped down annulus 59 as well as particulate matter P picked up and any well fluids that may be present in or that may enter the well. FIG. 7 illustrates the cleaning process for the well proceeding in time, where string S has been lowered further into the mass of particulate matter P.

Figure 8:
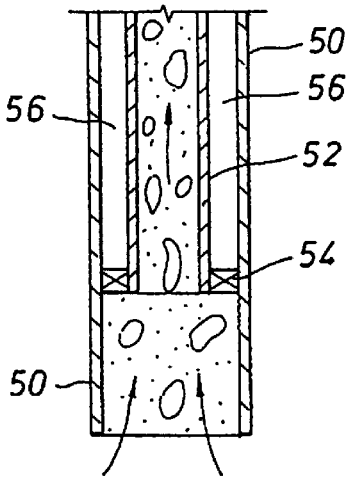
FIG. 8 illustrates an internal flow path of string S.

FIG. 8 illustrates an internal flow path of string S comprised of an inner and outer tubing. In FIG. 8 fluid circulation can include fluid pumped down a well. including gases pumped down the well, as well as fluid and particulate matter picked up from the well. The fluid pumped up proceeds up string S initially through the bore of outer coil 50 and subsequently through the bore of inner tubing 52. The inner tubing outer coil annulus 56 is sealed, as indicated in FIG. 8, by seal 54. Fluid pressure in annulus 56 may be monitored at the surface to check for leaks in either inner tubing 52 or outer coil 50.

Figure 9:
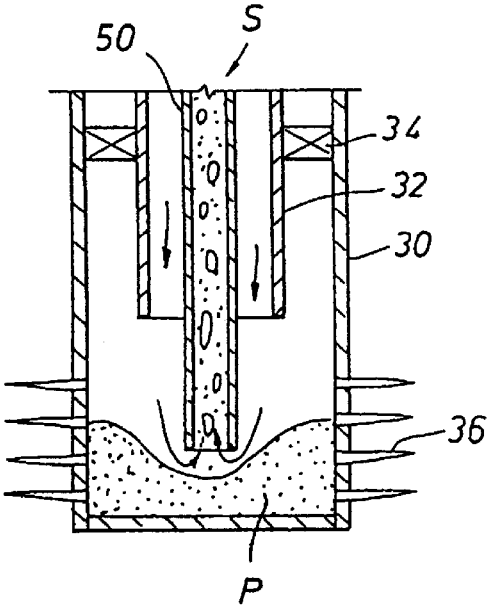
FIGS. 9 and 10 illustrate progress of a well clean up.
Figure 10:
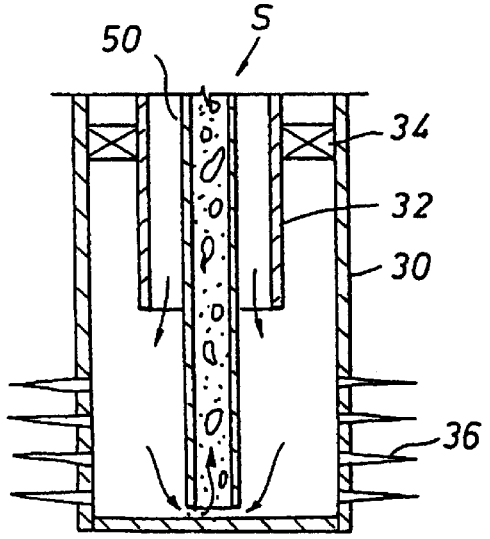
Figure 11:
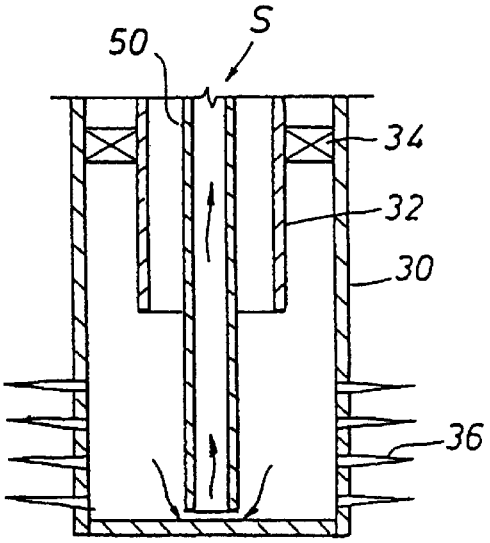
FIG. 11 illustrates reverse circulating after clean up.

FIGS. 9 and 10 illustrate further progress of a well clean out operation. FIG. 11 illustrates reverse circulating relatively clean fluid down the production tubing-tubing string annulus and up the tubing string. Return of a relatively clean fluid, or fluid minus particulate matter, indicates completion of a clean out of sand plugging well perforations.

Figure 12:
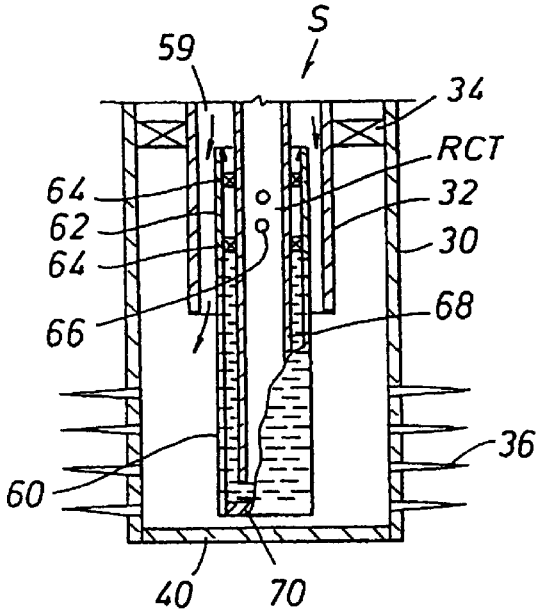
FIG. 12 illustrates a through tubing gravel pack methodology.

FIG. 12 illustrates portions of a through tubing gravel pack methodology of the present invention. The well in FIG. 12 may have been cleaned of residual particulate matter by the method illustrated in the prior figures. Into the well of FIG. 12, defined by casing 30, perforations 36, plugback 40, production tubing 32 and production tubing casing packer 34, string S has been lowered, having connected to its lower end a reverse circulating and release sub (referred to herein as sub RCT) carrying ports 66 and isolation seals 64. Circulating and release sub RCT illustrated generally in FIG. 12 is connected at its lower end to wash tube 68, which could be another section of coiled tubing. Releasably carried by circulating and release sub RCT is gravel pack screen 60 attached at its upper end to blank pipe 62. Isolation seals 64 seal above and below circulation ports 66 between the circulating and release sub and the blank pipe, or preferably a high strength extension tube portion of a blank pipe of the gravel pack assembly. The gravel pack assembly typically comprises gravel pack screen 60 at the lower end of blank pipe 62 and carrying a bull plug 70 at its lower end.

Figure 13:
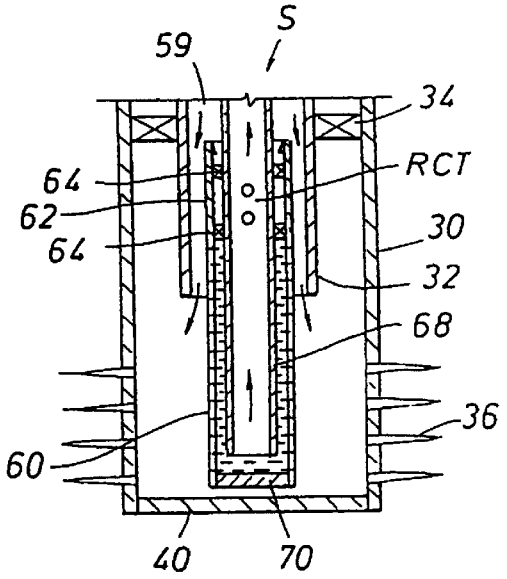
FIG. 13 illustrates setting a gravel pack.
Figure 22:
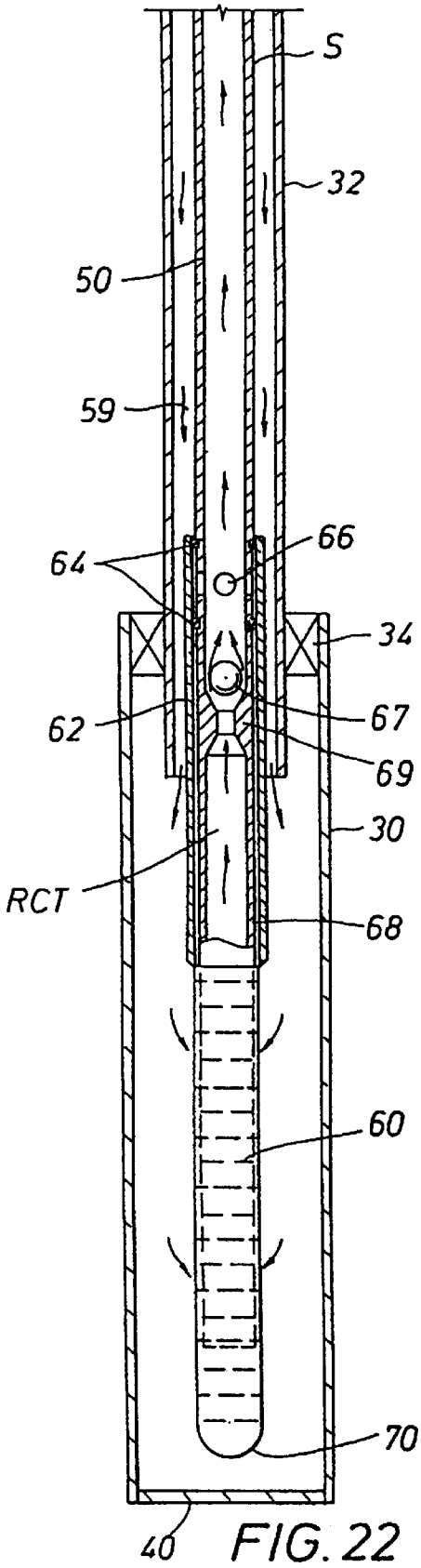
FIG. 22 illustrates a reverse circulation path through a gravel pack assembly.

FIGS. 13 and 22 illustrate(s) setting a gravel pack by through tubing reverse circulating with coiled tubing, a methodology of the instant invention. Gravel is indicated as being circulated down annulus 59 between production tubing 32 and string S. The fluid flows on the outside of blank pipe 62 due to isolation seals 64 sealing the annulus between circulating sub RCT and blank pipe 62. The gravel of the slurry being pumped down annulus 59 below production tubing 32 falls to the bottom of the well bore of casing 30 and builds up on the outside of screen 60, between screen 60 and perforations 36 and casing 30. Liquid from the slurry pumped down annulus 59 passes through screen 60 into the space between screen 60 and wash tube 68, carried at the end of sub RCT. Liquid passing through screen 60 proceeds to the bottom of wash tube 68 and thence up the wash tube 68 bore, through circulating sub RCT and up string S to the surface. Well fluids entering the well as through perforations 36 may also pass through the gravel in screen 60 and up wash tube 68, through circulating sub RCT and up string S.

Figure 14:
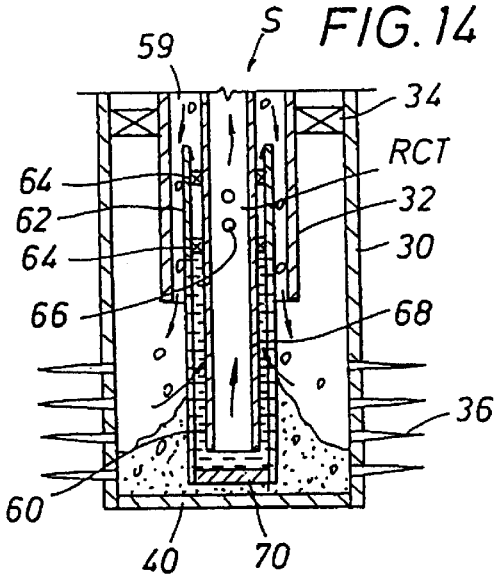
Figure 15:
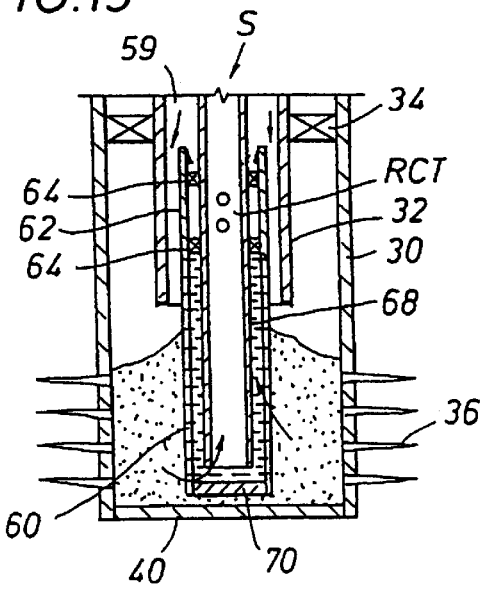
Figure 16:
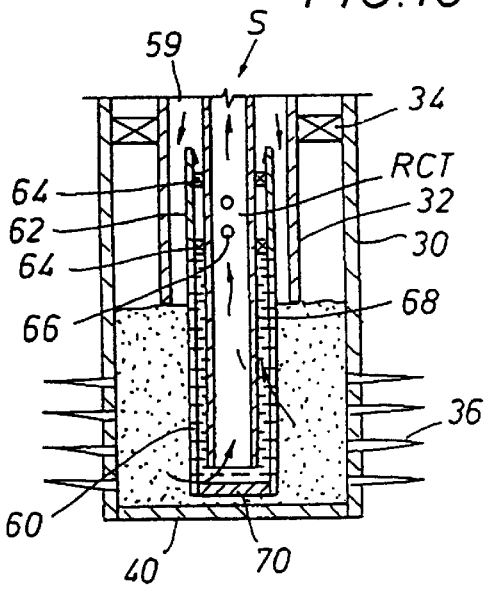

FIGS. 14, 15 and 16 illustrate completing the gravel packing of the well in accordance with a preferred embodiment of the instant method and apparatus. As the gravel packing nears completion, as indicated in FIG. 16, back pressure on the slurry being pumped down annulus 59 will rise indicating that gravel is tending to completely encircle screen 60 of the pack assembly.

Figure 23:
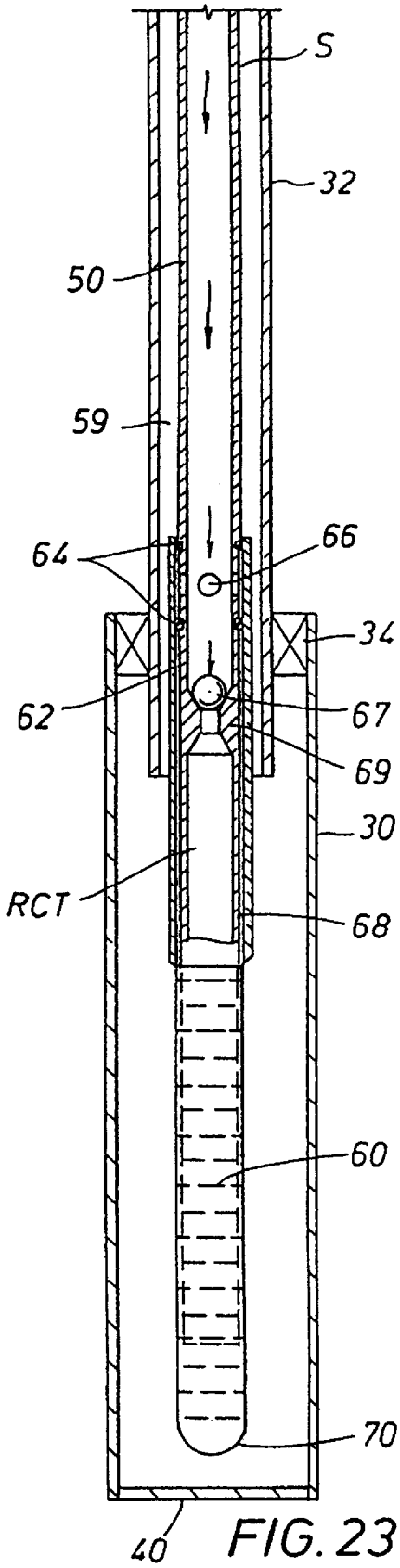
FIG. 23 illustrates activating a release mechanism.
Figure 24:
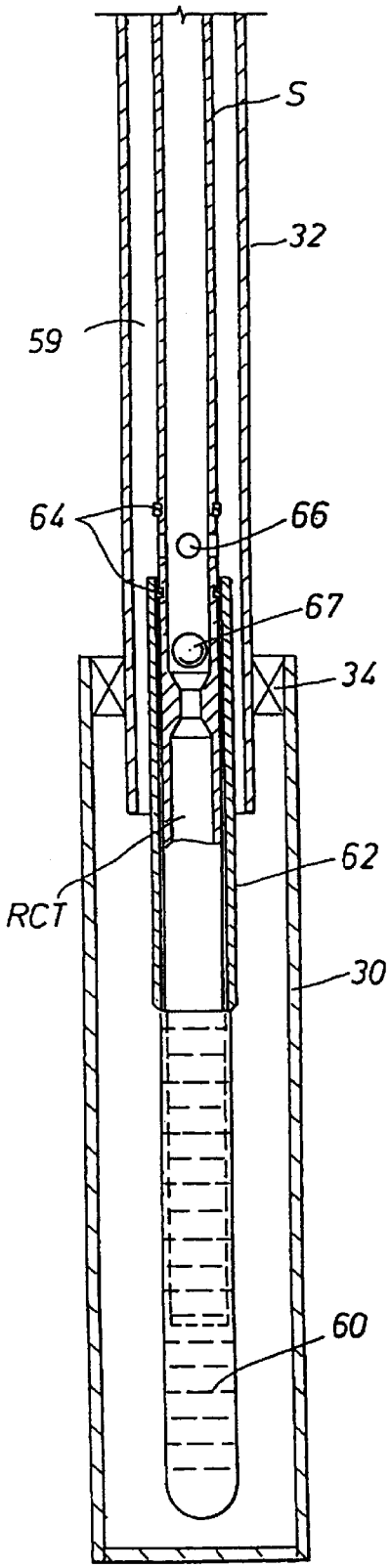
FIG. 24 illustrates reverse circulating to clean out slurry.

As indicated in FIG. 17, upon determination that the packing operation is complete, as by sensing back pressure on the slurry in the annulus, string S and reverse circulating sub RCT release themselves from the gravel pack assembly comprising blank pipe 62 and screen 60. A releasing mechanism will be more particularly described in relation to FIG. 25. FIG. 23 illustrates utilizing ball 67 in sub RCT to seat on seat 69 by pressuring down string S. Such a mechanism can be used to effect a release of sub RCT from the blank pipe and screen assembly. Coiled tubing string S is then lifted in a preferred embodiment, as illustrated in FIGS. 17 and 24, such that at least upper seal 64 clears the top of blank pipe 62, or at least clears sealing engagement with blank pipe 62. Clearing seal 64 from sealing engagement with the gravel pack assembly permits fluid in annulus 59 to continue to be pumped up hole by reverse circulating through string S by means of ports 66 that have now have been placed in fluid communication with annulus 59. By reverse circulating while holding such a position of the string, the remaining fluid and gravel slurry in the coil tubing-production tubing annulus 59 may be cleared out.

To complete the job, as indicated in FIG. 18, coiled tubing string S is reeled to the surface leaving gravel pack assembly 60 and blank pipe 62 with the gravel pack in the hole, substantially as indicated in FIG. 18. As is known in the art, a slick line or coiled tubing packer and holddown tool 100 may be lowered and placed into position between blank pipe 62 and production tubing 32. FIG. 19 illustrates packer and holddown apparatus or assembly 100 set in place between blank pipe 62 and production tubing 32. As FIG. 20 indicates, when the well is placed on production well fluids enter through perforations 36 pass through gravel pack GP and thence through screen 60, up blank pipe 62 and thence up production tubing 32 to the surface. FIG. 21 illustrates the completed gravel packed well.

FIG. 3, discussed above, illustrates a preferred embodiment of a protected coiled tubing string, a PCCT having an inner tubing 52 within an outer coiled tubing 50 and annulus 56 sealed y seal 54.

Figure 25A:
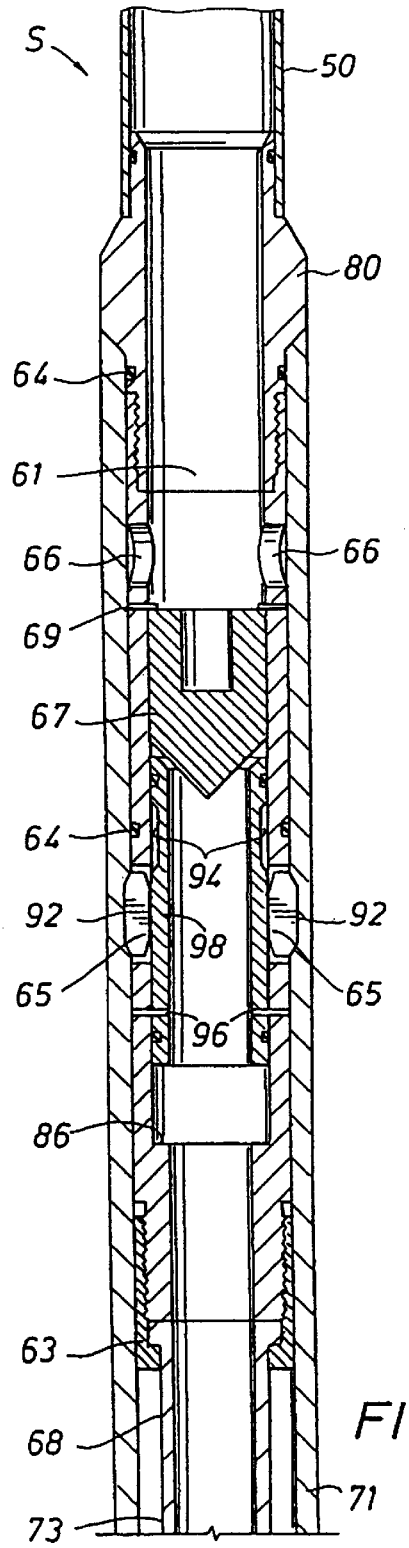
FIGS. 25A and 25B illustrate(s) circulating and release tool.
Figure 25B:
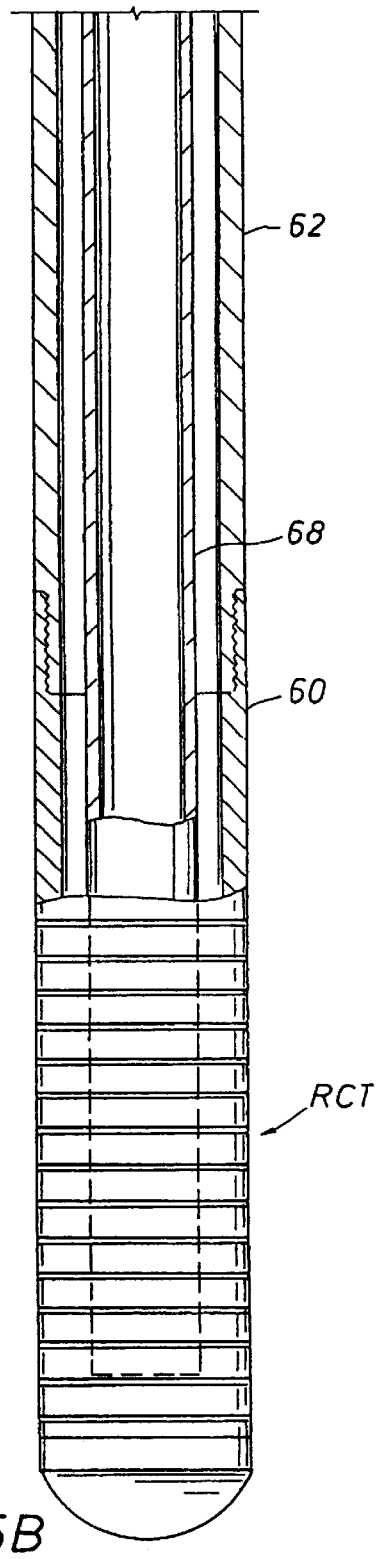

FIGS. 25A and 25B illustrates features of a preferred embodiment of a circulating and release sub RCT of the instant invention. Coiled tubing connector 80 in FIG. 25 is shown connecting circulating sub RCT with coiled tubing string S. The inside diameter of coil tubing connector 80 might be a minimum of ¾ of an inch. Upper and lower seals 64 are shown sealing above and below ports 66 of circulating sub RCT and between circulating sub RCT and extension tube 71. Connector 63 in FIG. 25 is shown connecting the lower portion of circulating sub RCT with the upper portion of wash pipe 68. Wash pipe 68 might be simply a section of coiled tubing sized to fit inside the screen and blank pipe. To make the connection, upper end of pipe 68 could be flared, as indicated in FIG. 25 by flared end 73. Check valve 67 is illustrated sealing inside passageway 61 of circulating sub RCT. It can be seen that from the structure of circulating sub RCT and check valve 67, fluid flow is permitted up sub RCT by check valve 67 but would not be permitted down sub RCT by check valve 67. The inside diameter of sub RCT might be approximately ¾ of an inch. Dogs 65 between sub RCT and extension tube 71 serve to releasably attach the blank pipe 62 to the tool. The upper end of blank pipe 62 is comprised of an extension tube 71 that may be four to five feet in length to extend the sub RCT downhole. In the embodiment of FIG. 25 check valve 67 seats against element 98 which in conjunction with other structure serves to releasably attach sub RCT to extension tube 71 of blank pipe 62. Upon supplying sufficient pressure downhole on check valve 67 shearpins 96 can be sheared and check valve 67 will move unit 98 downward until it seats upon a lower shoulder 86. Movement of unit 98 downward moves cavity 94 in line with dogs 65. When dogs 65 are received into cavity 94 its engagement with recess 92 in blank pipe 62 is lost. Such movement releasably detaches sub RCT from blank pipe 62. As previously mentioned the upper end of blank pipe 62 is preferably comprised of a four to five foot extension tube 71 of an high strength alloy material) probably specially machined to accommodate seals and latches.

Figure 26A:
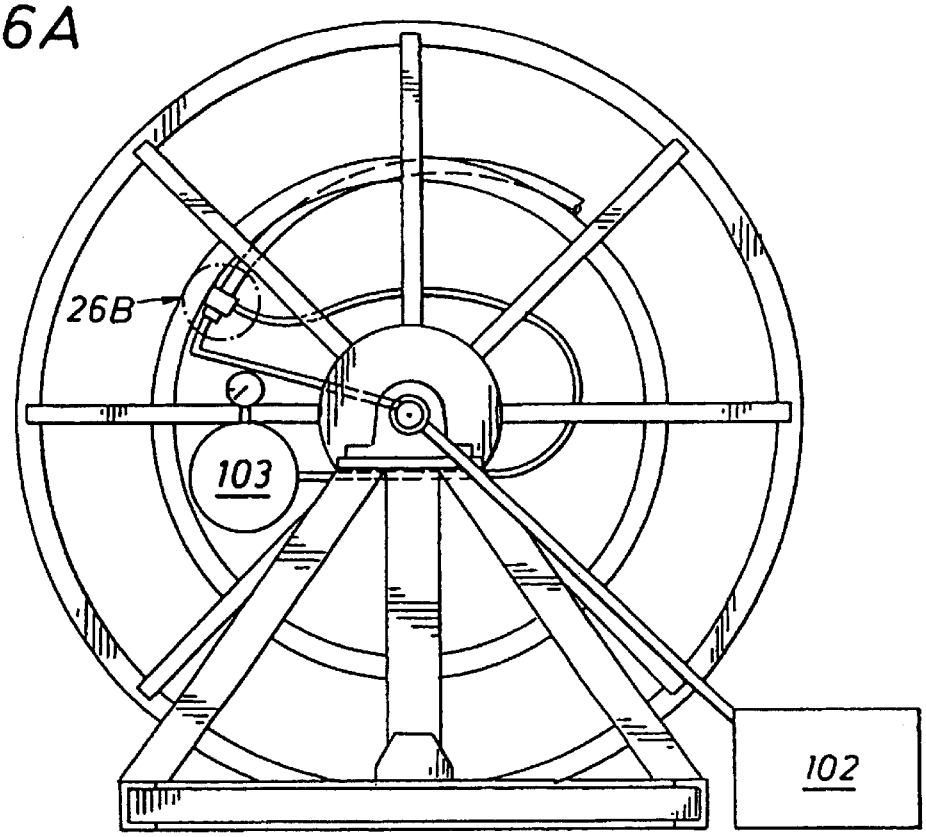
FIGS. 26A and 26B illustrate(s) a reel for an at least partial coil-in-coil tubing string including means for pressurizing and monitoring a fluid in an annulus between an inner tubing and an outer coiled tubing.
Figure 26B:
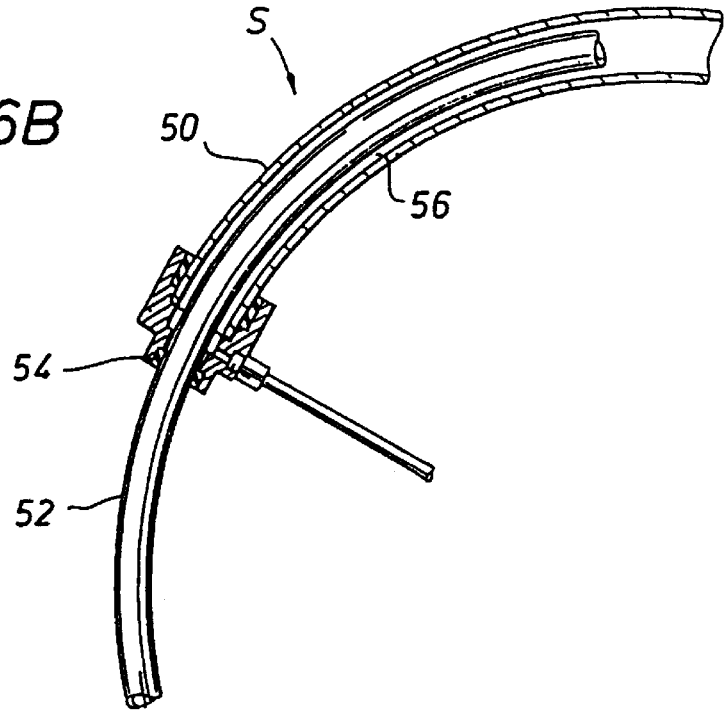

FIG. 26A illustrates a reel that might carry an at least partial coil-in-coil tubing, PCCT. The reel is shown connected to a source of natural gas through valving through the reel axle, the natural gas 102 or other gas such as nitrogen 103 may be usable for a gas lift operation. Since the inner tubing on the reel shaft passing through the axle does not deform, at this point an extra protective layer for the tubing is not necessary. FIG. 26B also shows a partial coil-in-coil tubing, PCCT, wherein inner tubing 52 is shown sealed by seal 54 at its lower end against outer coil 50. The inner and outer coil are part of String S. The outer diameter of outer coil 50 might be 1½" while the inner diameter of outer coil 50 might be 1.28 inches. The outer diameter of inner coil 52 could be 1³⁄₁₆ inches. The annulus 56 between inner tubing 52 and outer coil 50 would thus be in the order of 0.1 inches.

Figure 27:
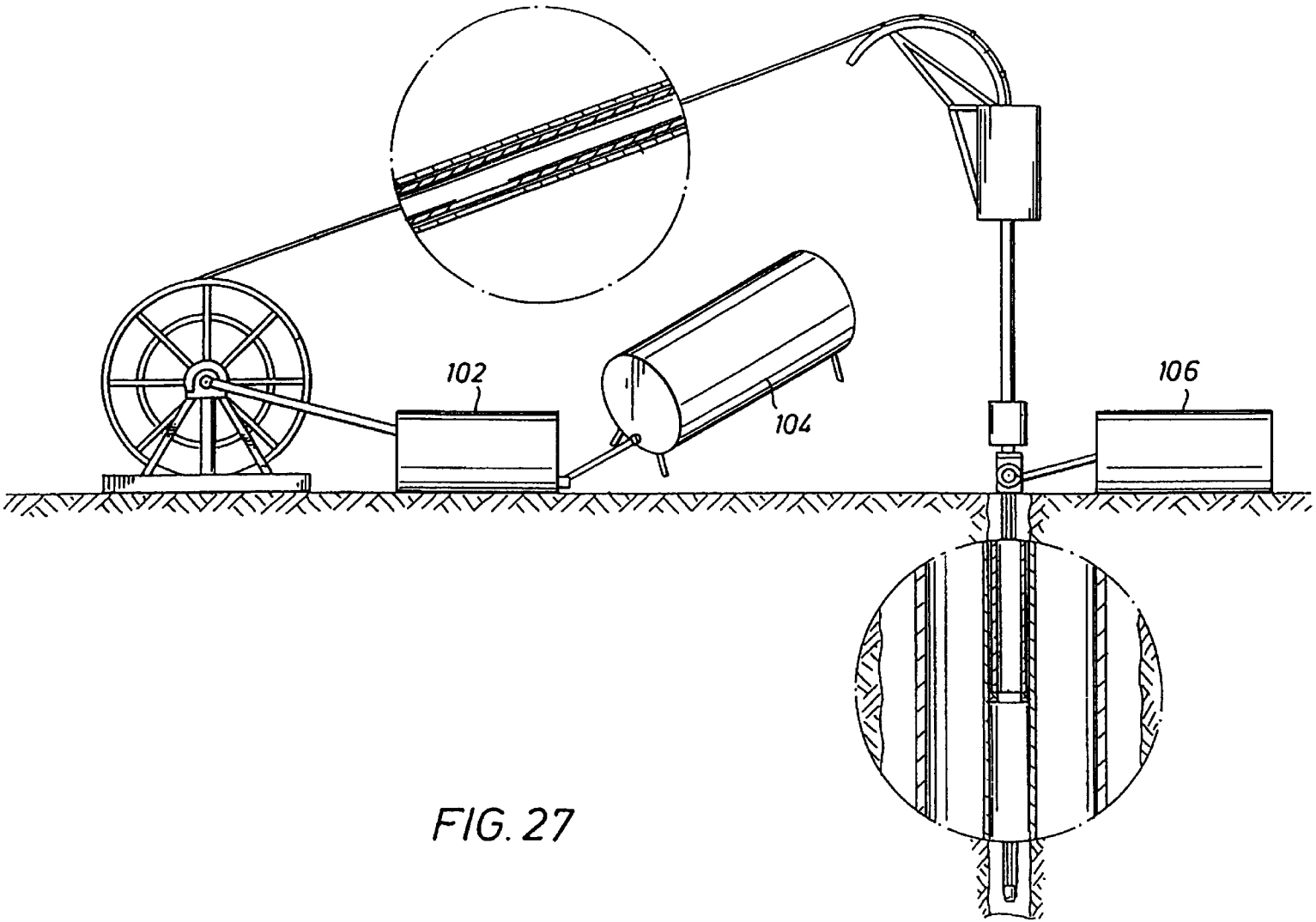
FIG. 27 illustrates a partial coil-in-coil tubing string running in a wellbore, as such string might be run for use in gas lift.

FIG. 27 illustrates a gas lift operation where natural gas 102, or other gas such as nitrogen from cylinder 104, is pumped down an at least partial coil-in-coil tubing into a wellbore. Well fluids are pumped up the coil tubing-well or production tubing annulus along with gas 102. Well fluid pumped up the annulus is treated in the usual manner at the wellhead and collected in tank 106. Also, natural gas 102 or other gas may be reverse circulated into a wellbore to spur or restart production from a "dead" well that has stopped producing.

Figure 28A:
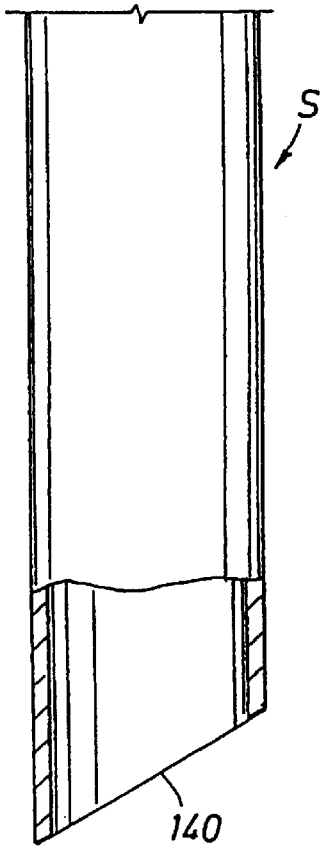
FIGS. 28A–28D illustrate wash nozzles installed at the end of a coiled tubing string and appropriate for reverse circulation use.
Figure 28B:
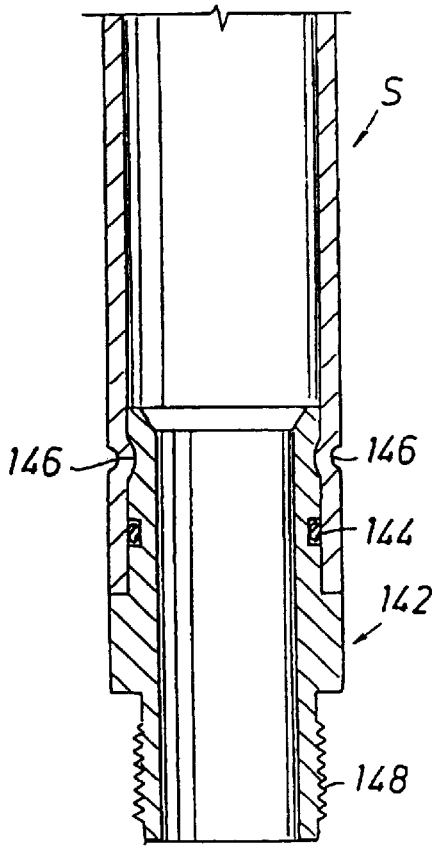
Figure 28C:
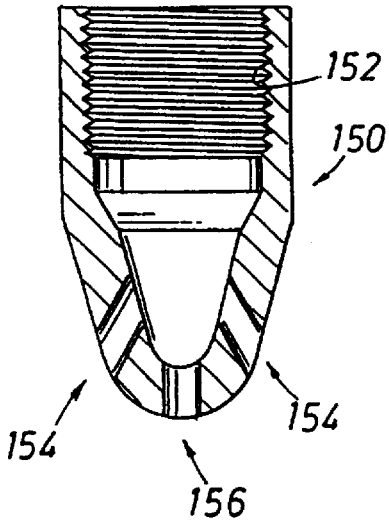
Figure 28D:
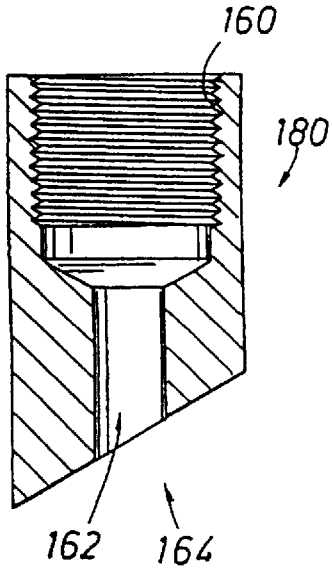

FIGS. 28A–28D illustrate preferred embodiments for wash nozzles that may be used to reverse circulate well fluids and may be installed at the end a coiled tubing string S. FIG. 28A illustrates a coiled tubing string S having end 140 cut at an angle to facilitate reverse circulation, such as in for removal of sand from a wellbore. As illustrated in FIG. 28B, end 140 of string S (so may be fitted with sub 142 for connecting a wash nozzle to string S. Such sub 142 may connect with dogs 146 disposed within the inner coiled tubing of string S and carry seal 144 for sealing the connection as well as screw threads 148 for connection to any type of wash nozzle. FIGS. 28C and 28D illustrate preferred embodiments of wash nozzles. FIG. 28C illustrates a wash nozzle 150 having screw threads 152 for matching engagement with screw threads 148 of sub 142 and wash ports 154 and 156 for fluid communication between string S and the wellbore. FIG. 28D illustrates another wash nozzle embodiment, wash nozzle 180 having a wash port 162 disposed at end 164 of wash nozzle 180 for fluid communication between string S and the wellbore and screw threads 160 for matching engagement with threads 148 of sub 142, for connecting to string S. End 156 of wash nozzle 150 may be blunt as shown in FIG. 28C. Alternatively, end 164 of wash nozzle 180 may be cut at an angle, such as shown in FIG. 28D.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumption that recitation of a single element covers one or more, and recitation of two elements covers two or more, and the like.

What is claimed is:

1. A method for gravel packing a well, comprising:

running a coiled tubing string downhole;

injecting a gravel pack slurry down a well-coiled tubing annulus; and reverse circulating fluid up the coiled tubing string, including past a wellhead.

2. The method of claim 1 that includes inserting a gravel pack screen assembly down the well utilizing the coiled tubing string.

3. The method of claim 2 that includes attaching a circulating and release sub between the screen assembly and the coiled tubing string.

4. The method of claim 1 that includes running the string through production/completion tubing.

5. The method of claim 1 that includes cleaning particulate matter from a wellbore using a coiled tubing string prior to injecting a gravel pack slurry down the well.

6. The method of claim 5 wherein the cleaning step includes reverse circulating through the string.

7. A method for gravel packing a well, comprising:

running a coiled tubing string downhole;

injecting a gravel pack slurry down a well-coiled tubing annulus;

reverse circulating fluid up the coiled tubing string, including past a wellhead; and running the coiled tubing string having a leak protection barrier operable for at least a portion of the string above the wellhead.

8. The method of claim 7 wherein the leak protection barrier includes at least partial dual tubing.

9. The method of claim 7 that includes inserting a gravel pack screen assembly down the well utilizing the coiled tubing string.

10. The method of claim 9 that includes attaching a circulating and release sub between the screen assembly and the coiled tubing string.

11. A method for well enhancement comprising:

running a coiled tubing string down production tubing, the string having a leak protection barrier operable for at least a portion of the string above a wellhead;

circulating fluid down a production tubing -coiled tubing annulus; and reverse circulating fluid and particulate matter up the coiled tubing string, including past the wellhead.

12. The method of claim 11 that includes setting a gravel pack by inserting a screen assembly in the well at the end of the coiled tubing string, and pumping a gravel slurry down the production tubing coiled tubing annulus and reverse circulating slurry filtrate up the coiled tubing.

13. The method of claim 11 that includes adapting an end of the coiled tubing string as a work tool.

14. A method for lifting fluid from a well, comprising:

creating a production tubing-coiled tubing string annulus in the well;

circulating natural gas down the annulus;

producing well fluid up the coiled tubing string; and providing a protective barrier for the coiled tubing string above a wellhead.

15. The method of claim 14 wherein the protective barrier for the coiled tubing string includes an inner tubing located in at least an upper portion of an outer tubing of the string.

16. Gravel pack apparatus, comprising:

coiled tubing;

a screen assembly; and a circulating and release sub attached, directly or indirectly, between the coiled tubing and the screen assembly, the sub having at least one port, adjustable between open and closed, structured to permit fluid circulation between outside and inside the coiled tubing string; and a release mechanism, adjustable to latch and to detach the sub from the screen assembly.

17. The apparatus of claim 16 where the screen assembly includes a screen portion attached to a blank pipe portion.

18. The apparatus of claim 16 wherein a wash pipe is attached to the circulating and release sub.

19. The apparatus of claim 16 that includes at least one seal structured to seal between the sub and a portion of the screen assembly.

20. The apparatus of claim 16 wherein the circulating and release sub includes at least one check valve structured to form part of the release mechanism and to form a reverse circulating tool to assist reverse circulation.

21. The apparatus of claim 20 wherein the reverse circulation tool includes at least two seals located on a body of the tool, one above and one below the at least one port.

22. The apparatus of claim 16 wherein the coiled tubing comprises an outer coiled tubing string having an inner tubing located at least along an upper portion of the coiled tubing string and a seal located and structured to seal an annulus between the inner tubing and the string.

23. The apparatus of claim 14 wherein the blank pipe includes an extension tubing portion formed of a high strength material.

24. A method for lifting fluid from a well, comprising:

creating a production tubing-coiled tubing string annulus in the well;

circulating natural gas down the coiled tubing string;

producing well fluid up the annulus; and providing a protective barrier for the coiled tubing string above a wellhead.

25. The method of claim 24 wherein the protective barrier for the coiled tubing string includes an inner tubing located in at least an upper portion of an outer tubing of the string.

26. The method of claim 25 that includes running the string through production/completion tubing.

27. The method of claim 25 that includes cleaning particulate matter from a wellbore using a coiled tubing string prior to injecting a gravel pack slurry down the well.

28. The method of claim 27 wherein the cleaning step includes reverse circulating through the string.

* * * * *